US009724943B2

(12) United States Patent
Hara

(10) Patent No.: US 9,724,943 B2
(45) Date of Patent: Aug. 8, 2017

(54) LIQUID DISCHARGE APPARATUS

(71) Applicant: SEIKO EPSON CORPORATION, Tokyo (JP)

(72) Inventor: Osamu Hara, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/171,648

(22) Filed: Jun. 2, 2016

(65) Prior Publication Data

US 2016/0368291 A1 Dec. 22, 2016

(30) Foreign Application Priority Data

Jun. 16, 2015 (JP) ..... 2015-121400

(51) Int. Cl.
*B41J 23/00* (2006.01)
*B41J 19/14* (2006.01)
*B41J 13/14* (2006.01)

(52) U.S. Cl.
CPC ..... *B41J 19/142* (2013.01); *B41J 13/14* (2013.01)

(58) Field of Classification Search
None
See application file for complete search history.

(56) References Cited

U.S. PATENT DOCUMENTS

2011/0242208 A1* 10/2011 Kato ..... B41J 2/16538 347/33
2011/0273513 A1* 11/2011 Norasak ..... B41J 2/1753 347/44
2014/0111587 A1 4/2014 Nakano et al.

FOREIGN PATENT DOCUMENTS

| | | | |
|---|---|---|---|
| JP | 2004-330446 | A | 11/2004 |
| JP | 2007-307863 | A | 11/2007 |
| JP | 2011-161885 | A | 8/2011 |
| JP | 2014-083707 | A | 5/2014 |
| JP | 2016-132180 | | 7/2016 |
| WO | 2016-117286 | | 7/2016 |

OTHER PUBLICATIONS

Kumagai, Toshio, Liquid Injection Apparatus, Nov. 25, 2004, Japan, All.*

* cited by examiner

*Primary Examiner* — Matthew Luu
*Assistant Examiner* — Tracey McMillion
(74) *Attorney, Agent, or Firm* — Workman Nydegger

(57) ABSTRACT

A liquid discharge apparatus includes a support portion that supports a sheet that is transported and a discharge unit that includes a carriage that is freely movable in scanning directions that intersect with a transport direction of the sheet and a liquid discharge head that is mounted on the carriage and that discharges ink to the sheet. End portions of the discharge unit in the scanning directions are provided with a plurality of ribs that are protruded along the scanning directions and that are provided so as to be juxtaposed with intervals in the transport direction. The ribs press a bend of the sheet toward the support portion as the carriage moves along the scanning directions.

4 Claims, 6 Drawing Sheets

LIQUID DISCHARGE APPARATUS

BACKGROUND

1. Technical Field

The present invention relates to a liquid discharge apparatus, for example, an ink jet printer.

2. Related Art

A known example of printing apparatuses (liquid discharge apparatuses) is an ink jet printer in which a droplet discharge head (liquid discharge head) is provided on a carriage (mobile body) that is freely movable in the scanning directions so that droplets (liquid) are discharged from the droplet discharge head to a recording medium supported on a platen (support portion). In this type of printer, it sometimes happens that a part of the recording medium bends (cockles) when droplets are discharged to the recording medium from the droplet discharge head or when the recording medium is transported on the platen in a transport direction that intersects with the scanning directions. Therefore, JP-A-2014-83707 discloses a printing apparatus in which a bend smoothing-out member that eliminates bend formed in a recording medium is provided on the carriage.

In the printing apparatus described in JP-A-2014-83707, when a recording medium has a bend, a pressing portion having a slant surface which is formed on an end portion of the bend smoothing-out member contacts a bent portion of the recording medium as the carriage moves in a scanning direction and presses the portion of contact toward the platen to remove the bend from the recording medium. In this situation, the slant-surfaced pressing portion, besides pressing the recording medium toward the platen, sometimes guides air into a gap between the bend smoothing-out portion and the platen. If such guided air is further guided to flow into a gap between the droplet discharge head and the platen, there is a risk of adversely affecting the landing accuracy of droplets that the droplet discharge head discharges to the recording medium.

Therefore, in order to discharge from the gap between the platen and the droplet discharge head the air guided into the gap by the pressing portion, the bend smoothing-out portion of the printing apparatus described in JP-A-2014-83707 is provided with a through hole that extends through the bend smoothing-out portion in an up-down direction and a guide groove that guides air from a pressing portion-side opening to a gap-side opening of the through hole.

However, the guide groove and the through hole described above are provided so as to discharge from the gap between the droplet discharge head and the platen by the slant-surfaced pressing portion only a portion of the air guided into the gap, and do not solve, in the least, the problem of the pressing portion guiding air toward the gap between the droplet discharge head and the platen.

SUMMARY

An advantage of some aspects of the invention is that a liquid discharge apparatus capable of reducing the bend formed in a medium supported by a support portion and also reducing the flow rate of gas guided to a gap between the support portion and a liquid discharge head that discharges liquid to the medium is provided.

A liquid discharge apparatus according to an aspect of the invention includes a support portion that supports a medium that is transported and a discharge unit that includes a mobile body that is freely movable in a scanning direction that intersects with a transport direction of the medium and a liquid discharge head that is mounted on the mobile body and that discharges liquid to the medium. An end portion of the discharge unit in the scanning direction is provided with a plurality of protruded portions that are protruded along the scanning direction and that are provided so as to be juxtaposed with an interval in the transport direction. The protruded portions press a bend of the medium toward the support portion as the mobile body moves along the scanning direction.

According to this liquid discharge apparatus, the protruded portions reduce the flow rate of gas guided toward a gap between the discharge unit and the support portion when the discharge unit moves in the scanning direction, in comparison with the case where a portion that contacts a portion of the medium in which bend has formed and that presses the medium toward the support portion is provided with a surface that is elongated and continuous in the transport direction. Therefore, the bend formed in the medium supported by the support portion can be reduced and, at the same time, the flow rate of gas guided toward the gap between the support portion and the liquid discharge head that discharges liquid to the medium can be reduced.

In the foregoing liquid discharge apparatus, the protruded portions may be made up of platy ribs that have a rigidity and that extend in the scanning direction.

With this construction of the protruded portions, during movement in the scanning direction, an end surface of at least one platy rib having a rigidity contacts a portion of the medium in which bend has formed. Therefore, even if a protruded portion contacts the medium during movement in the scanning direction, the risk of deformation of that protruded portion is small. Hence, the protruded portions can sufficiently press the medium toward the support portion, so that the bend formed in the medium can be reduced.

In the foregoing liquid discharge apparatus, a guide surface that guides gas that flows in between adjacent protruded portions of the plurality of protruded portions which are adjacent to each other in the transport direction into a direction toward an opposite side of the protruded portions to a direction in which the protruded portions press the medium when the mobile body moves along the scanning direction is provided between the adjacent protruded portions.

According to this construction, the gas that flows in between the protruded portions when the mobile body moves in the scanning direction is guided by the guide surface into a direction toward the opposite side of the protruded portions to the direction in which the protruded portions press the medium. Therefore, the flow rate of gas guided toward the gap between the liquid discharge head and the support portion when the mobile body moves in the scanning direction can be reduced.

In the foregoing liquid discharge apparatus, the guide surface may be a slant surface that is inclined or a bowed surface that curves.

According to this construction, the gas that flows into the gaps between the protruded portions that are adjacent to each other in the transport direction can be smoothly guided into a direction toward the opposite side of the protruded portions to the direction in which the protruded portions press the medium.

In the foregoing liquid discharge apparatus, the discharge unit may include an extension portion that extends along the scanning direction from the mobile body, and the protruded portions may be provided on an end portion of the extension portion in the scanning direction.

According to this construction, since the extension portion that extends along the scanning direction is provided on the mobile body, air stream is less easily produced between the liquid discharge head and the support portion when the mobile body moves along the scanning direction. That is, the deviation in the landing position of liquid that the liquid discharge head discharges to the medium supported by the support portion can be reduced.

BRIEF DESCRIPTION OF THE DRAWINGS

The invention will be described with reference to the accompanying drawings, wherein like numbers reference like elements.

DESCRIPTION OF EXEMPLARY EMBODIMENTS

An exemplary embodiment of an ink jet printer (hereinafter, sometimes referred to simply as "printer") that performs recording by discharging ink to a medium will be described as an example of a liquid discharge apparatus according to the invention with reference to the accompanying drawings.

Figure 1:
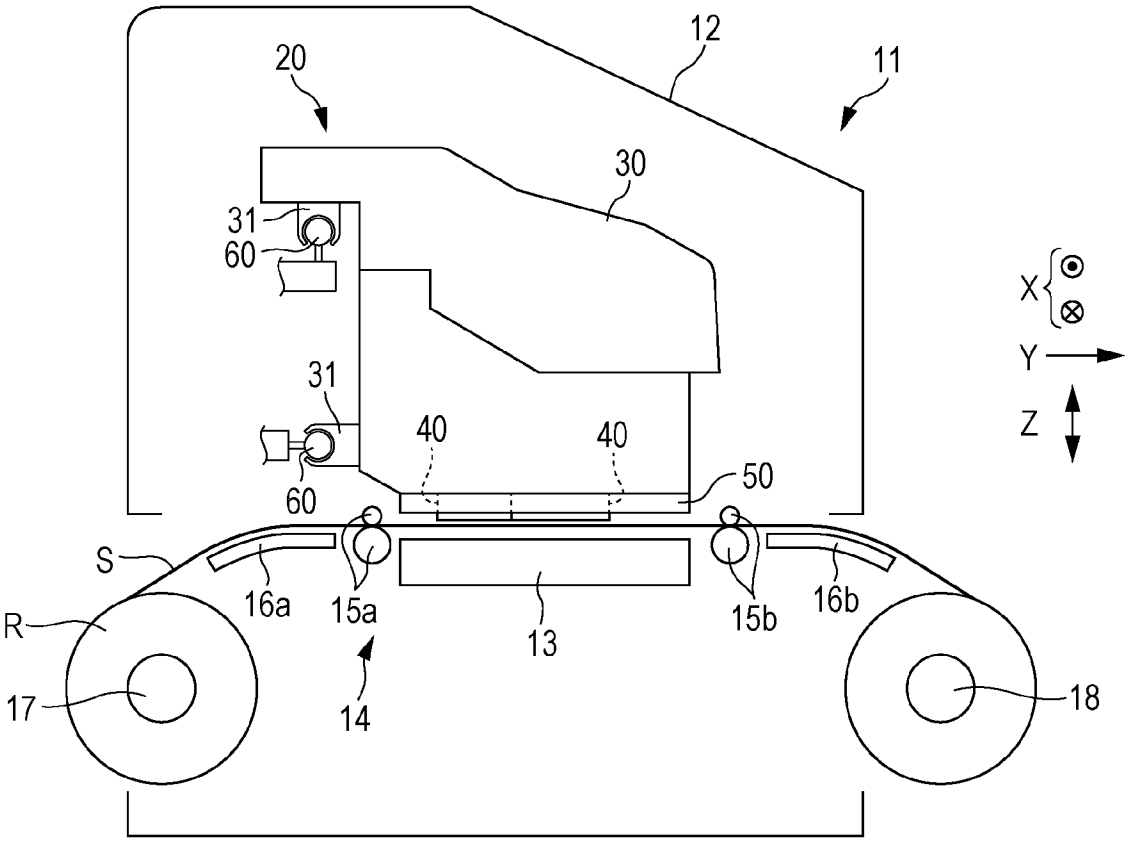
FIG. 1 is a side sectional view of a printer in an exemplary embodiment of the invention.

As shown in FIG. 1, a printer (liquid discharge apparatus) 11 includes a casing 12. Within the casing 12 there are provided a support portion 13 that supports a sheet S, an example of the medium, from a lower side in a vertical direction Z, a transport portion 14 that transports the sheet S in a transport direction Y along an upper surface of the support portion 13, and a discharge unit 20 that performs recording by discharging ink, an example of liquid, to the sheet S that is transported.

The transport portion 14 includes transport roller pairs 15*a* and 15*b* that are disposed at locations at an upstream side and a downstream side, respectively, of the support portion 13 in the transport direction Y. The transport roller pairs 15*a* and 15*b* each transport the sheet S along the transport direction Y by rotating while nipping the sheet S from above and below. Furthermore, the transport portion 14 further includes guide plates 16*a* and 16*b* that are disposed at locations at the upstream side of the transport roller pair 15*a* and the downstream side of the transport roller pair 15*b*, respectively, in the transport direction Y. The guide plates 16*a* and 16*b* guide the sheet S along the transport direction Y by supporting the sheet S from the lower side.

In the transport portion 14, a motor (not graphically shown) is driven to rotate the transport roller pairs 15*a* and 15*b* so as to transport the sheet S along the upper surface of the support portion 13 and the upper surfaces of the guide plates 16*a* and 16*b*. In this exemplary embodiment, the sheet S is transported as the sheet S is fed from a roll body R that has been wound in a cylindrical shape on a supply reel 17. The sheet S that is fed and transported from the roll body R is subjected to recording by the discharge unit 20 discharging ink, and then is wound again into a cylindrical shape by a take-up reel 18.

The discharge unit 20 includes a carriage (mobile body) 30 provided so as to be movable back and forth along the scanning directions X that are the directions of width of the sheet S and that intersect with the transport direction Y of the sheet S, a liquid discharge head 40 that discharges ink to the sheet S, and a stream shaping plate 50 that is an extension portion that extends along the scanning directions X. The carriage 30 is supported by guide shafts 60 that extend along the scanning directions X, via bearings 31 provided on the carriage 30, so that the carriage 30 is movable along the guide shafts 60. The liquid discharge head 40 is mounted on the carriage 30 and is exposed from a lower surface of the carriage 30 that is a lower side of the carriage 30 in the vertical directions Z so that the liquid discharge head 40 faces the support portion 13. The stream shaping plate 50 is also provided on the lower surface of the carriage 30 so as to face the support portion 13. Incidentally, a lower surface of the liquid discharge head 40 is disposed on the carriage 30 so as to slightly protrude from the lower surface of the stream shaping plate 50.

Figure 2:
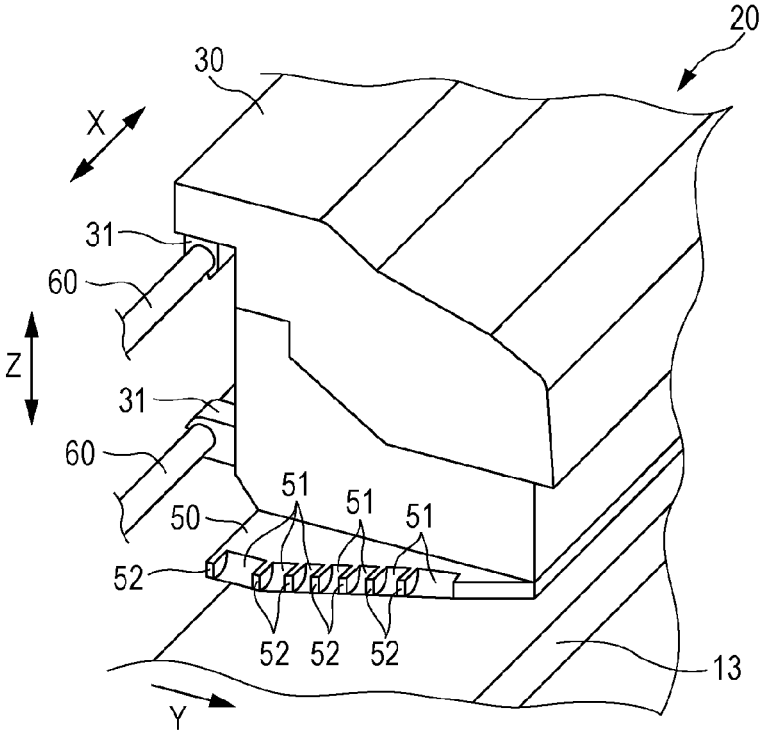
FIG. 2 is a perspective view showing portions of a discharge unit.
Figure 3:
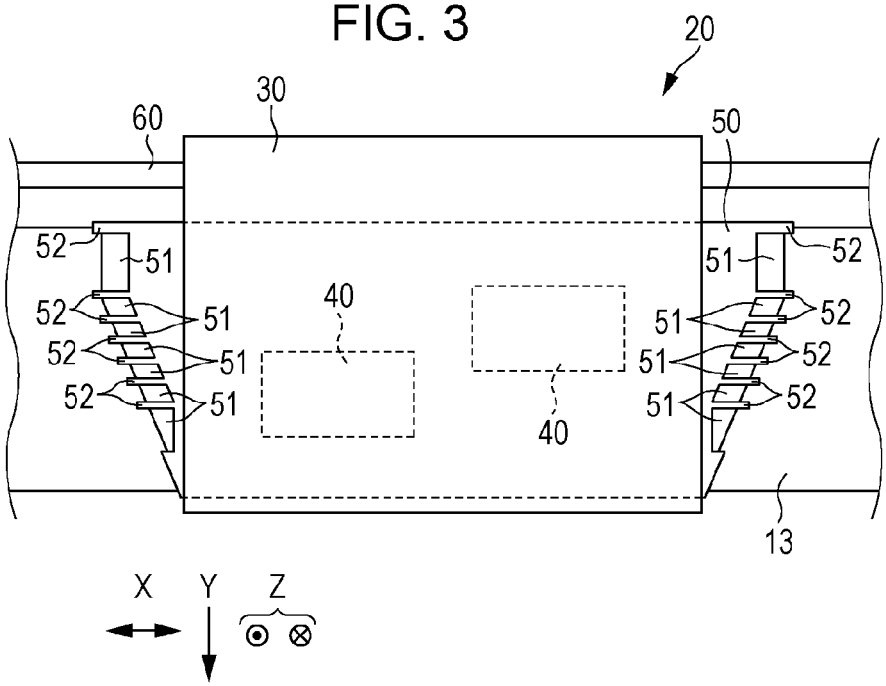
FIG. 3 is a top view of the discharge unit.

As shown in FIGS. 2 and 3, the stream shaping plate 50 of the discharge unit 20 is provided extending in the scanning directions X so that the length thereof in the scanning directions X is longer than the length of the carriage 30. Furthermore, the stream shaping plate 50 has a tapered shape whose length in the scanning directions X decreases from the upstream side to the downstream side in the transport direction Y.

End portions of the stream shaping plate 50 in the scanning directions X are provided with guide surfaces 51 that are bowed surfaces that curve. The guide surfaces 51 are arranged along the transport direction Y. Each guide surface 51 has a plow shape that curves further toward an upper side in the vertical directions Z as the distance from the end of the stream shaping plate 50 along the scanning directions X increases toward the carriage 30 (see FIG. 4). Because of these guide surfaces 51, the length of the stream shaping plate 50 in the scanning directions X is longer along the upper surface thereof that is to the upper side in the vertical directions Z than along the lower surface that is to the lower side in the vertical directions Z.

Furthermore, the end portions of the stream shaping plate 50 in the scanning directions X are each provided with a plurality of ribs 52 that are protruded portions that protrude from the guide surfaces 51 in a direction away from the carriage 30, of the scanning directions X. Each rib 52 has a platy shape in which the thickness of the rib 52 is in a direction along the transport direction Y, and has a rigidity. The ribs 52 are juxtaposed with intervals in the transport direction Y. Specifically, on the end portions of the stream shaping plate 50 in the scanning directions X, each guide surface 51 is formed at a location between adjacent ones of the ribs 52 in the transport direction Y.

Figure 4:
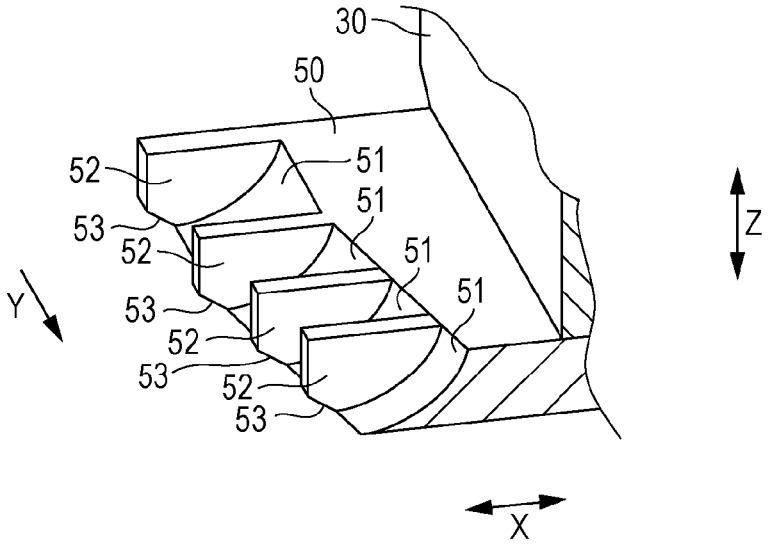
FIG. 4 is a perspective sectional view showing an end portion of a stream shaping plate in a scanning direction.

The ribs 52 extend from the guide surfaces 51. The guide surface 51-side end of each rib 52 is herein termed the proximal end. Then, a distal end of each rib 52 that is opposite to the proximal end thereof is provided with an oblique portion 53 that is oblique to the scanning directions X, as shown in FIG. 4. This oblique portion 53 of each rib 52 is provided in a part of a lower-side portion of the rib 52 in the vertical directions Z is obliquely inclined so as to extend toward the upper side in the vertical directions Z, from the proximal end to the distal end of the rib 52. Incidentally, the guide surfaces 51, the ribs 52, and the oblique portions 53 as mentioned above are provided not only on one side end portion of the stream shaping plate 50 in the scanning directions X but similarly provided on the other side end portion as well.

Next, operation of the printer (liquid discharge apparatus) 11 constructed as described above will be described.

Figure 5:
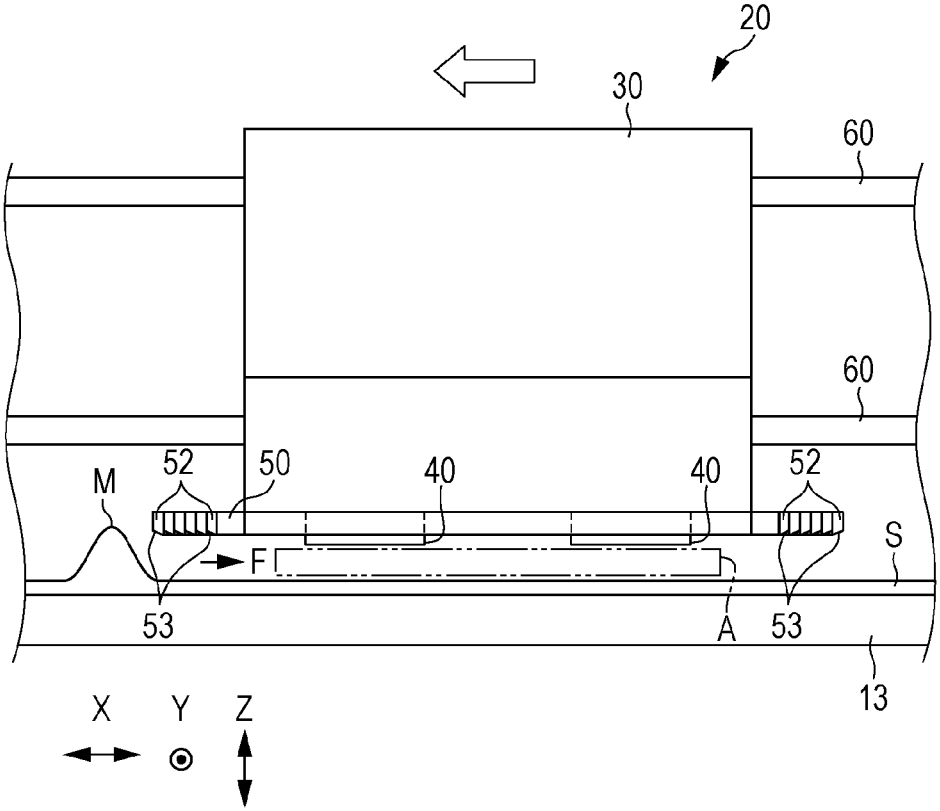
FIG. 5 is a front view of discharge unit during movement along the scanning directions.

As shown in FIG. 5, to perform recording on the sheet S supported by the support portion 13, the carriage 30 moves back and forth along the guide shafts 60 above the support portion 13 and ink is discharged from the liquid discharge head 40 to the sheet S. At this time, because of the discharge of ink, the nipping by the transport roller pairs 15*a* and 15*b*, or the like, bend (cockling) is sometimes formed in the sheet S so that a portion of the sheet S has a lifted portion M.

If a lifted portion M is formed in the sheet S, there arises a risk of the lifted portion M contacting the liquid discharge head 40 as the carriage 30 moves along the scanning directions X. Contact between the liquid discharge head 40 and the lifted portion M of the sheet S results in deposition of dust, paper powder, etc. on the liquid discharge head 40 or deposition of ink discharged onto the sheet S, so that the liquid discharge head 40 is stained or damaged, which is undesirable. To cope with this, the printer 11 in this exemplary embodiment is equipped with the ribs 52 that are provided on the stream shaping plate 50 in the discharge unit 20.

If a lifted portion M is formed in the sheet S, first, ribs 52 provided on one of the end portions of the stream shaping plate 50 in the scanning directions X contact the lifted portion M and press the lifted portion M toward the support portion 13, so that the lifted portion M is lessened or eliminated. That is, the risk of the sheet S contacting the liquid discharge head 40 is reduced. Furthermore, each rib 52 provided on the stream shaping plate 50 is provided with the oblique portion 53. The oblique portions 53 of the ribs 52 make it possible to more effectively press the lifted portion M toward the support portion 13 when the ribs 52 contact the sheet S.

Furthermore, when the carriage 30 moves along the guide shafts 60, it sometimes happens that air stream (flow of gas) F along the scanning directions X occurs in a space A between the liquid discharge head 40 and the sheet S supported on the support portion 13. The air stream F occurring in the space A may possibly adversely affect the landing position of ink on the sheet S. However, in the printer 11 in this exemplary embodiment, the stream shaping plate 50 elongated along the scanning directions X is provided in the discharge unit 20, so that the flow resistance against the gas (air) in the space A becomes large. Therefore, the flow rate and the flow speed of the air stream F that flows into the space A between the liquid discharge head 40 and the sheet S supported on the support portion 13 are reduced, so that the deviation in the landing position of ink is reduced.

Figure 6:
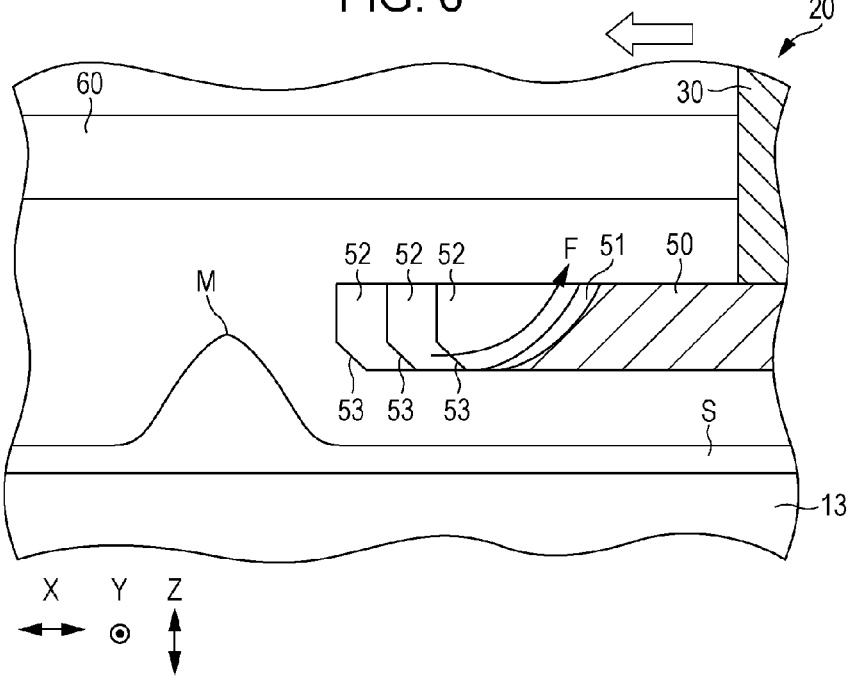
FIG. 6 is a diagram illustrating flow of air that occurs when the discharge unit moves in a scanning direction.

As shown in FIG. 6, either end portion of the stream shaping plate 50 in the scanning directions X is provided with the guide surfaces 51. Because these guide surfaces 51 have a plow shape that curves toward the upper side in the vertical directions Z, the air stream F is guided along the guide surfaces 51 toward the upper side in the vertical directions Z when the carriage 30 moves in the direction indicated by a blank arrow, of the scanning directions X. That is, the guide surfaces 51 guide the air stream F into a direction toward the opposite side of the ribs 52 to a direction in which the ribs 52 press the sheet S. Therefore, the flow rate of the air stream F that flows into the space between the liquid discharge head 40 and the sheet S supported on the support portion 13 is reduced. Furthermore, since the ribs 52 have a platy shape that has a thickness in a direction along the transport direction Y, the air stream F is easily guided to the guide surfaces 51.

Figure 7:
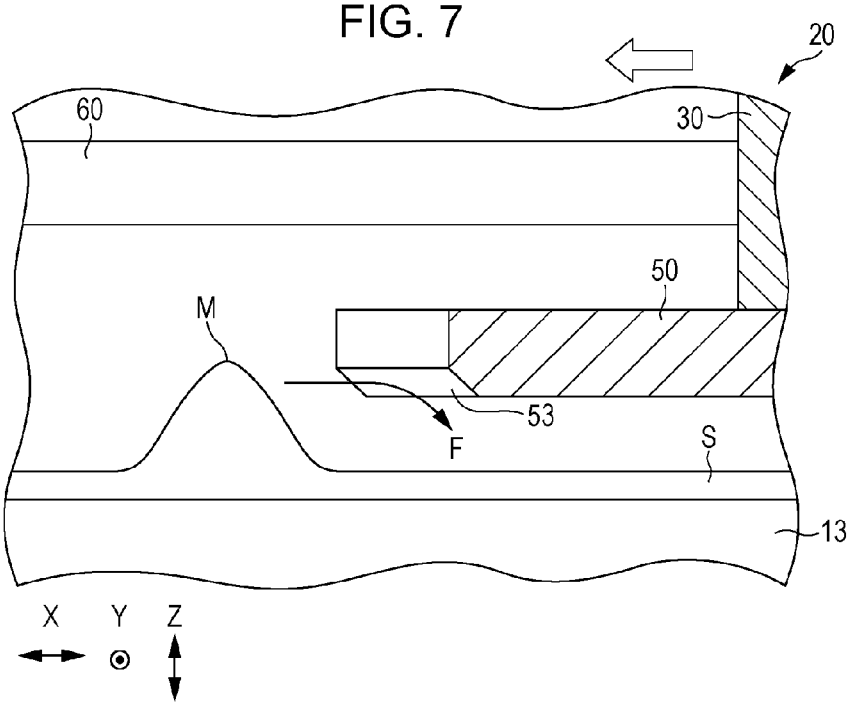
FIG. 7 is a diagram illustrating flow of air that occurs when a discharge unit as a comparative example moves in a scanning direction.

If, as in a comparative example shown in FIG. 7, a discharge unit 20 in which each end portion of a stream shaping plate 50 in the scanning directions X is provided with an oblique portion 53 that is elongated and continuous in the transport direction Y (i.e., no guide surfaces 51 and no ribs 52 are provided) is moved in the direction indicated by a blank arrow, of the scanning directions X, an end portion of the stream shaping plate 50 in the scanning direction X presses the lifted portion M toward the support portion 13. On the other hand, the air stream F is guided along the oblique portion 53 formed on each end portion of the stream shaping plate 50 in the scanning directions X so as to enter the space between the liquid discharge head 40 and the sheet S supported on the support portion 13. That is, the flow rate and the flow speed of the air stream F in the space A increase, giving rise to a risk of adversely affecting the landing accuracy of ink.

Therefore, the printer 11 in this exemplary embodiment includes the ribs 52 that press the lifted portion M formed in the sheet S toward the support portion 13 and, at the same time, the guide surfaces 51 that have such a plow shape as to guide the air stream F into a direction toward the opposite side of the ribs 52 to the direction in which the ribs 52 press the lifted portion M. That is, while the ribs 52 press the sheet S toward the lower side in the vertical directions Z, the guide surfaces 51 guide the air stream F flowing between the adjacent ribs 52 so that the air stream F is directed toward the upper side in the vertical directions Z. Incidentally, since the ribs 52 have a platy shape that has a thickness in a direction along the transport direction Y, the contact area of the ribs 52 with the sheet S is reduced. That is, the flow rate of the air stream F guided along the oblique portion 53 toward the lower side in the vertical directions Z is reduced.

According to the foregoing exemplary embodiment, the following advantageous effects can be obtained.

(1) In the discharge unit 20, the ribs 52 that press the lifted portion M of the sheet S toward the support portion 13 are juxtaposed with intervals in the transport direction Y. Therefore, the ribs 52 reduce the flow rate of gas guided toward the space A between the discharge unit 20 and the support portion 13 when the discharge unit 20 moves the scanning directions X, in comparison with the case where a portion that contacts a lifted portion M of the sheet S and presses the lifted portion M toward the support portion 13 is provided with a surface that is elongated and continuous in the transport direction Y. Therefore, the bend formed in the sheet S supported on the support portion 13 can be reduced and, at the same time, the flow rate of gas guided toward the space between the support portion 13 and the liquid discharge head 40 that discharges ink to the sheet S can be reduced.

(2) When the discharge unit 20 moves in the scanning directions X, the platy ribs 52 that have a rigidity contact, at their end surfaces in the scanning directions X, the lifted portion M that is a portion in which the sheet S has bent. Therefore, even if a rib 52 contacts the lifted portion M during movement along the scanning directions X, the risk of deformation of that rib 52 is small. Hence, the ribs 52 can sufficiently press the lifted portion M toward the support portion 13, so that the bend formed in the sheet S can be reduced.

(3) The gas that flows into the gaps between the ribs 52 when the carriage 30 moves along the scanning directions X is guided by the guide surfaces 51 into a direction toward the opposite side of the ribs 52 to the direction in which the ribs 52 press the sheet S. Therefore, the flow rate of gas guided toward the space between the support portion 13 and the liquid discharge head 40 when the carriage 30 moves in the scanning directions X can be reduced.

(4) The guide surfaces 51 are each formed by a bowed surface that curves toward the upper side in the vertical directions Z as the distance from the end of the stream shaping plate 50 along the scanning directions X increases toward the carriage 30. Therefore, the gas that flows into the gaps between the ribs 52 that are adjacent to each other in the transport direction Y can be smoothly guided into a direction toward the opposite side of the ribs 52 to the direction in which the ribs 52 press the sheet S.

(5) Since the stream shaping plate 50 extending along the scanning directions X is formed on the carriage 30, air stream is less likely to occur between the liquid discharge head 40 and the support portion 13 when the carriage 30 moves along the scanning directions X. That is, the deviation in the landing position of ink that the liquid discharge head 40 discharges to the sheet S supported by the support portion 13 can be reduced.

(6) Since each rib 52 is provided with the oblique portion 53, the ribs 52 can more effectively press the lifted portion M to the support portion 13 side when coming into contact with the lifted portion M. Specifically, the ribs 52 having the oblique portions 53 can more effectively lessen or eliminate the lifted portion M.

(7) The end portions of the discharge unit 20 in the scanning directions X are provided with the ribs 52 that are protruded portions extending along the scanning directions X. Therefore, when the discharge unit 20 moves along the scanning directions X, the lifted portion M comes into contact with the ribs 52 before contacting the liquid discharge head 40, so that the ribs 52 press the lifted portion M toward the support portion 13 and thus lessen or eliminate the lifted portion M. Therefore, the risk of the liquid discharge head 40 contacting the lifted portion M and therefore being stained or damaged can be reduced.

The foregoing exemplary embodiment may be modified as follows.

Figure 8:
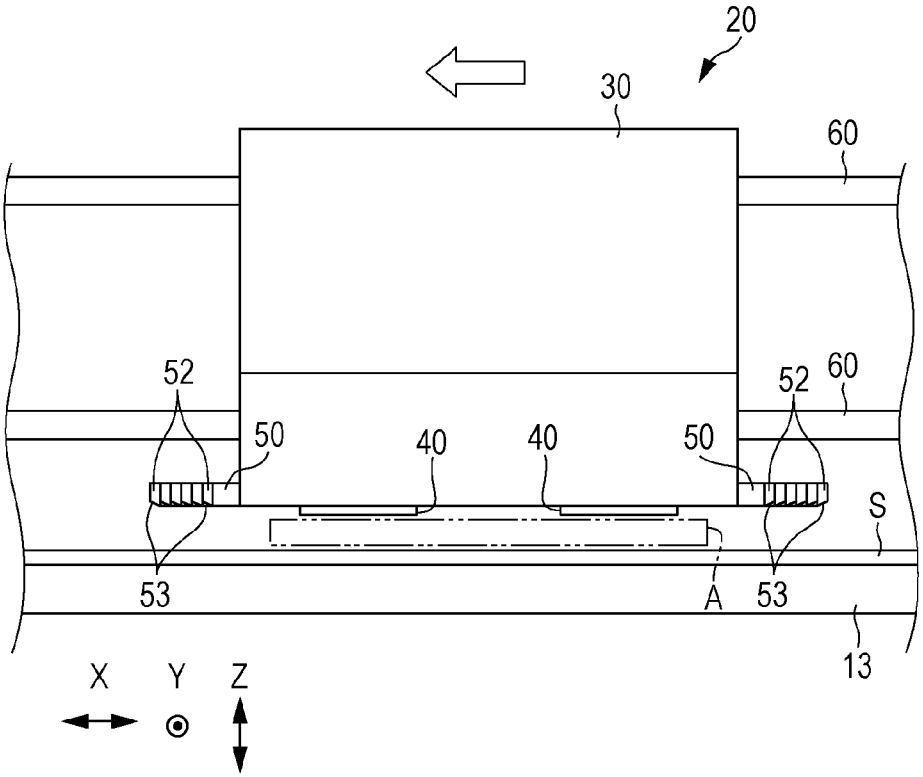
FIG. 8 is a diagram illustrating a modification of the stream shaping plate.

In the foregoing exemplary embodiment, the stream shaping plate 50 is not limited to the construction in which the stream shaping plate 50 extends along the scanning directions X from the lower surface of the carriage 30 but may instead have a construction as shown in FIG. 8 in which a stream shaping plate 50 extends along the scanning directions X from either side surface of the carriage 30. In this construction, each of the two end portions of the carriage 30 in the scanning directions X is provided with the stream shaping plate 50, and the liquid discharge head 40 is exposed from the lower surface of the carriage 30.

Figure 9:
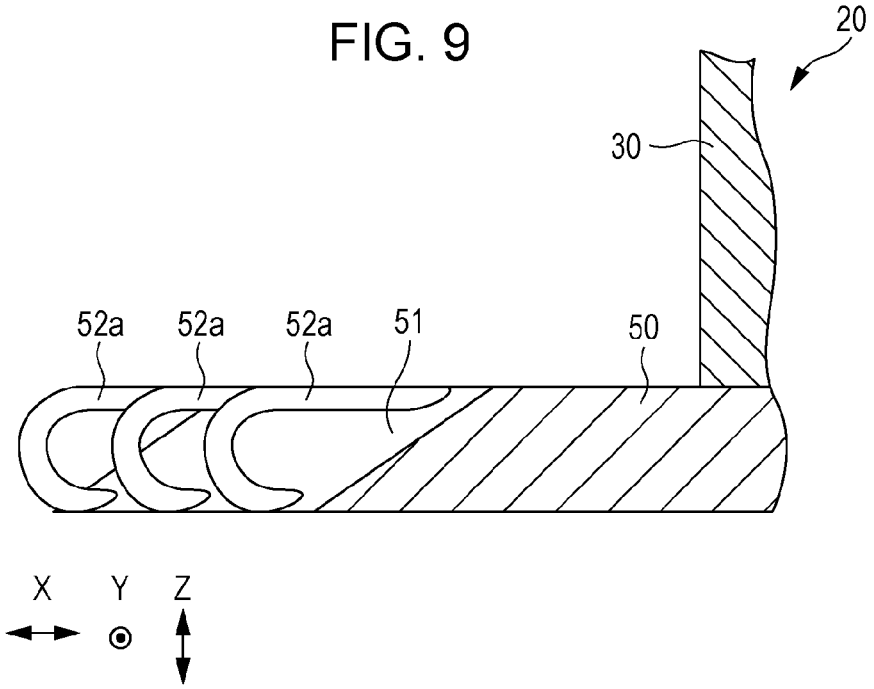
FIG. 9 is a diagram illustrating a modification of a guide surface and a protruded portion.

In the foregoing exemplary embodiment, the protruded portions provided on the end portions of the stream shaping plate 50 in the scanning directions X are not limited to the platy ribs 52 but may also be protruded portions that do not have a platy shape, for example, pipes 52*a* as shown in FIG. 9. Furthermore, the protruded portions are not limited to the pipes 52*a* or the ribs 52. It suffices that the protruded portions are provided so as to be juxtaposed with intervals in the transport direction Y and have such a shape that the protruded portions can press the lifted portion M of the sheet S to the support portion 13 side.

In the foregoing exemplary embodiment, the guide surfaces 51 are not limited to a bowed surface shape but may also be a slant surface shape that is inclined as shown in FIG. 9. Furthermore, the guide surfaces 51 may each include a stepped portion.

Figure 10:
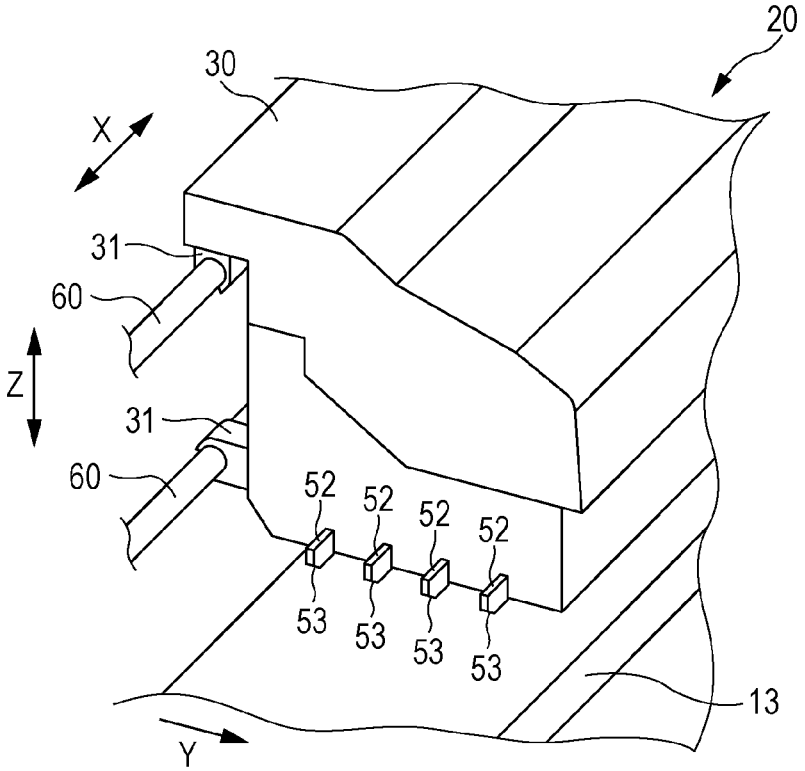
FIG. 10 is a diagram illustrating a modification of the discharge unit.

In the foregoing exemplary embodiment, the discharge unit 20 may have a construction that does not include the stream shaping plate 50, as shown in FIG. 10. In this construction, ribs 52 that are the protruded portions are formed on side surfaces of the carriage 30. The provision of the ribs 52 reduces the risk of the lifted portion M contacting the liquid discharge head 40. Furthermore, since the ribs 52 are juxtaposed with intervals in the transport direction Y, the flow rate of the air stream F guided toward the space A between the liquid discharge head 40 and the sheet S supported by the support portion 13 can be reduced. Furthermore, in the discharge unit 20 shown in FIG. 10 as a modification, guide surfaces 51 may be provided in gaps between the adjacent ribs 52 in the transport direction Y. The provision of the guide surfaces 51 will further reduce the flow rate of the air stream F guided toward the space A.

In the foregoing exemplary embodiment, each rib 52 does not necessarily need to have the oblique portion 53. Ribs 52 that do not have an oblique portion 53 are still able to press the lifted portion M toward the support portion 13 and lessen or eliminate the lifted portion M. The air stream F can be guided by the guide surfaces 51 toward the upper side in the vertical directions Z.

In the foregoing exemplary embodiment, the ribs 52 are not limited by the construction in which the ribs 52 are protruded from the guide surfaces 51. For example, a construction in which ribs 52 extend along the scanning directions X from gaps between a plurality of guide surfaces 51 that are provided independently of each other at a plurality of positions in the transport direction Y may be adopted.

In the foregoing exemplary embodiment, the lower surface of the stream shaping plate 50 and the lower surface of the liquid discharge head 40, which are to the lower side in the vertical directions Z, may be flush with each other. This flush surfaced construction can reduce the disturbance of the air stream F that flows between the liquid discharge head 40 and the support portion 13. The reduced disturbance of the air stream F facilitates correcting the landing positions of the ink. Incidentally, technologies for correcting the landing position of ink are known. Furthermore, the construction in which the lower surface of the liquid discharge head 40 and the lower surface of the stream shaping plate 50 are flush with each other can further reduce the risk of the liquid discharge head 40 contacting the lifted portion M of the sheet S.

In the foregoing exemplary embodiment, the shape of the stream shaping plate 50 is not limited to the tapered shape in which the length of the stream shaping plate 50 in the scanning directions X decreases from the upstream side to the downstream side in the transport direction Y but may also be, for example, a shape in which the length in the scanning directions X increases from the upstream side to the downstream side in the transport direction Y or a shape in which the length in the scanning directions X is consistent from the upstream side to the downstream side. Furthermore, the stream shaping plate 50 may have an elliptic shape. The shape of the stream shaping plate 50 is not limited by the foregoing exemplary embodiment.

In the foregoing exemplary embodiment, the discharge unit 20 is not limited to the construction in which the two end portions of the discharge unit 20 in the scanning directions X are each provided with the guide surfaces 51, the ribs 52, and the oblique portions 53, but may instead have a construction in which only one of the two end portions of the discharge unit 20 in the scanning directions X is provided with the guide surfaces 51, the ribs 52, and the oblique portions 53. In particular, bending (cockling) of the sheet S is often formed because ink is discharged to the sheet S. Therefore, in the case of the printer 11 whose discharge unit 20 ejects ink when moving in one direction and does not eject ink when moving in another direction, the possibility of the discharge unit 20 contacting the lifted portion M is considered to be high when the discharge unit 20, after having ejected ink while moving in the one direction, moves in the another direction. Therefore, the construction in which, in terms of the scanning directions X, only the end portion of the discharge unit 20 in the another direction is provided with the guide surfaces 51, the ribs 52, and the oblique portions 53 can lessen or eliminate the lifted portion M and, at the same time, guide the air stream F to the upper side in the vertical directions Z. Of course, a construction in which only the end portion of the discharge unit 20 in the one direction, which is the moving direction of the discharge unit 20 at the time of ejecting ink, is provided with the guide surfaces 51, the ribs 52, and the oblique portions 53 will also lessen or eliminate the lifted portion M and guide the air stream F to the upper side in the vertical directions Z since there remains a possibility of bend being formed in the sheet S when the sheet S is transported.

In the foregoing exemplary embodiment, the medium to which the liquid discharge head 40 discharges ink is not limited to the sheet S in the form of a continuous sheet unwound from the roll body R but may also be a cut sheet. Furthermore, the medium used in this exemplary embodiment is not limited to a sheet of paper but various kinds of media, including a cloth, metal foil, plastic, etc., may be used.

In the foregoing exemplary embodiment, the liquid discharge apparatus may also be a liquid discharge apparatus that discharges a liquid other than ink. The state of the liquid discharged in the form of droplets of very small amount from the liquid discharge apparatus includes a substantially circular drop state, a so-called teardrop state, a stringy state, etc. Furthermore, as for the liquid mentioned herein, a material that can be discharged from the liquid discharge apparatus suffices. What suffices as the liquid are, for example, substances in a liquid phase and include high-viscosity or low-viscosity liquid materials, sols, gel water, and other fluidal materials such as inorganic solvents, organic solvents, solutions, liquid resins, and liquid metals (metal melts). Furthermore, the liquid herein is not only a liquid as a state of a substance but may also include materials in which a particle of a functional material made up of a solid, such as a pigment or a metal particle, is dissolved, dispersed, or mixed in a solvent. Representative examples of the liquid include inks as described above in conjunction with the exemplary embodiment, liquid crystals, etc. The ink herein includes aqueous inks and oil-based inks as commonly used and various other liquid compositions such as gel inks and hot melt inks. Concrete examples of the liquid discharge apparatus include liquid discharge apparatuses that discharge liquid materials that contain in the form of dispersion or solution a material, such as an electrode material or a color material for use in production of liquid crystal displays, EL (electroluminescence) displays, surface-emitting displays, color filters, etc. Furthermore, the liquid discharge apparatus may also be a liquid discharge apparatus that discharges a bioorganic material for use in production of biochips, a liquid discharge apparatus that discharges a liquid as a specimen and that is used as a precision pipette, a textile printing apparatus, a microdispenser, etc. Furthermore, the liquid discharge apparatus may also be a liquid discharge apparatus that discharges a lubricant in a pinpoint manner to a precision machine, such as a clock or a camera, or a liquid discharge apparatus that discharges a transparent resin liquid, such as an ultraviolet curable resin, to a substrate in order to form a micro-hemispherical lens (optical lens) for use in an optical communication device or the like. Furthermore, the liquid discharge apparatus may also be a liquid discharge apparatus that discharges an etching solution of an acid, an alkali, etc. in order to etch a substrate or the like.

This application claims priority under 35 U.S.C. §119 to Japanese Patent Application No. 2015-121400, filed Jun. 16, 2015. The entire disclosure of Japanese Patent Application No. 2015-121400 is hereby incorporated herein by reference.

What is claimed is:

1. A liquid discharge apparatus comprising:

a support portion that supports a medium that is transported; and a discharge unit that includes a mobile body that is freely movable in a scanning direction that intersects with a transport direction of the medium and a liquid discharge head that is mounted on the mobile body and that discharges liquid to the medium, wherein an end portion of the discharge unit in the scanning direction is provided with a plurality of protruded portions that are protruded along the scanning direction and that are provided so as to be juxtaposed with a guide surface in between each protruded portion in the transport direction, wherein the guide surface is one or more of a bowed surface, a slant surface, and a stepped portion surface, and wherein the protruded portions press a bend of the medium toward the support portion as the mobile body moves along the scanning direction.

2. The liquid discharge apparatus according to claim 1, wherein the protruded portions are made up of platy ribs that have a rigidity and that extend in the scanning direction.

3. A liquid discharge apparatus according to claim 1, wherein the guide surface guides gas that flows in between adjacent protruded portions of the plurality of protruded portions which are adjacent to each other in the transport direction into a direction toward an opposite side of the protruded portions to a direction in which the protruded portions press the medium when the mobile body moves along the scanning direction.

4. The liquid discharge apparatus according to claim 1, wherein the discharge unit includes an extension portion that extends along the scanning direction from the mobile body, and the protruded portions are provided on an end portion of the extension portion in the scanning direction.

* * * * *